US006915767B2

(12) United States Patent
Pfeiffer et al.

(10) Patent No.: US 6,915,767 B2
(45) Date of Patent: Jul. 12, 2005

(54) METHOD OF DETERMINING THE POSITION OF A CAM PHASER

(75) Inventors: Jeffrey M. Pfeiffer, Walled Lake, MI (US); Gregg Stepien, Wixom, MI (US); Amanpal S. Grewal, Novi, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/668,756

(22) Filed: Sep. 23, 2003

(65) Prior Publication Data

US 2005/0061271 A1 Mar. 24, 2005

(51) Int. Cl.[7] ..... F01L 1/34

(52) U.S. Cl. ..... 123/90.15; 123/90.17; 74/568 R; 92/121

(58) Field of Search ..... 123/90.15–90.18; 74/568 R; 464/1, 2, 160; 92/121, 122

(56) References Cited

U.S. PATENT DOCUMENTS 6,047,674 A * 4/2000 Kadowaki et al. ..... 123/90.15
6,079,381 A * 6/2000 Morikawa ..... 123/90.15
6,085,706 A * 7/2000 Kadowaki et al. ..... 123/90.15

* cited by examiner

*Primary Examiner*—Thomas Denion
*Assistant Examiner*—Jaime Corrigan
(74) *Attorney, Agent, or Firm*—Jimmy L. Funke

(57) ABSTRACT

A method of determining the position of a cam phaser determines and stores an adaptively updated base offset corresponding to the phase offset of a camshaft relative to a crankshaft for a reference or default position of a cam phaser. Thereafter, the phaser position is determined relative to the base offset. Individual base offsets are preferably determined for each tooth of a toothed cam wheel, and stored in a non-volatile memory device. During engine operation, the base offsets are subject to diagnostic testing and adaptive updating, and the updated base offsets are stored in the non-volatile memory at engine shut-down.

8 Claims, 4 Drawing Sheets

METHOD OF DETERMINING THE POSITION OF A CAM PHASER

TECHNICAL FIELD

The present invention is directed to the control of a phaser mechanism for a camshaft of an internal combustion engine, and more particularly to a method of determining the position of the phaser.

BACKGROUND OF THE INVENTION

Phaser mechanisms for continuously varying the phase of a camshaft (intake and/or exhaust) relative to the crankshaft for purposes of reducing exhaust gas emissions and improving engine performance are well known in the art of internal combustion engine controls. In general, accurate knowledge of the phaser position is essential to the achievement of accurate phase angle control. However, inaccuracy can occur due to engine-to-engine variation, as well as mechanical and electrical variation within a given engine. For example, variations in engine operating temperature can produce variations in the air gap between a toothed wheel and a speed sensor, which in turn produces variations in the sensor output. Accordingly, what is needed is a method of accurately determining the phaser position in spite of such variations.

SUMMARY OF THE INVENTION

The present invention is directed to an improved method of determining the position of a cam phaser by reliably determining and storing an adaptive base offset corresponding to the phase offset of the camshaft relative to the crankshaft for a reference or default position of the phaser, and then determining the current phaser position relative to the base offset. Individual base offsets are preferably determined for each tooth of a toothed cam wheel, and stored in a non-volatile memory device. During engine operation, the base offsets are subject to diagnostic testing and adaptive updating, and the updated base offsets are stored in the non-volatile memory at engine shut-down.

DESCRIPTION OF THE PREFERRED EMBODIMENT

Figure 1:
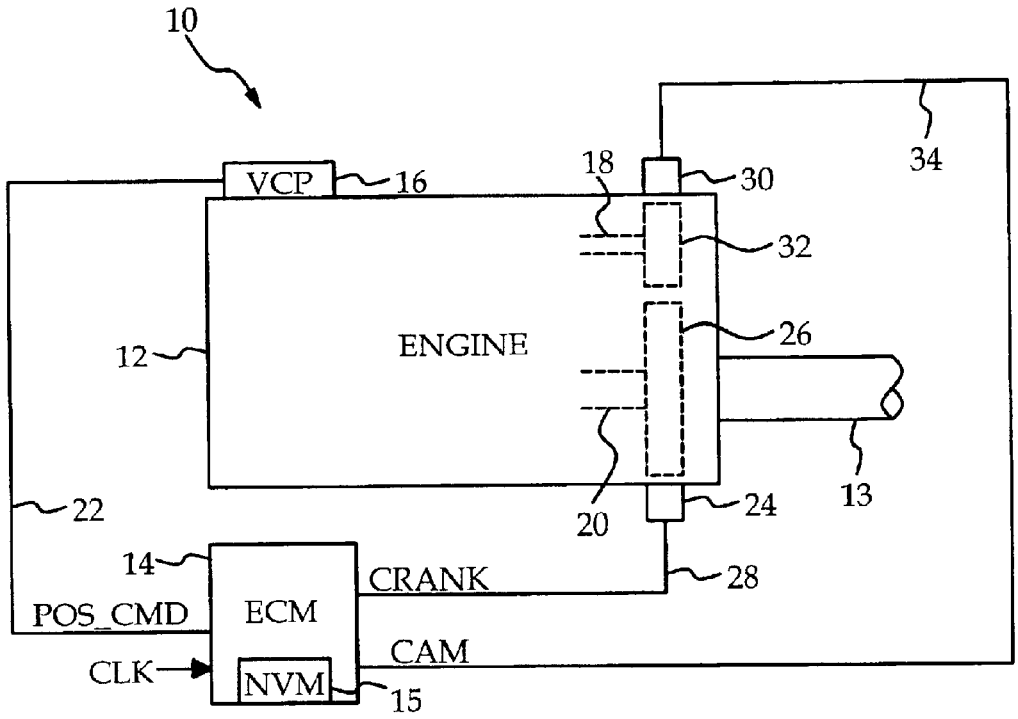
FIG. 1 is a diagram of a motor vehicle powertrain, including an internal combustion engine having a cam phaser and a microprocessor-based engine control module (ECM).

Referring to FIG. 1, the reference numeral 10 generally depicts a motor vehicle powertrain including an internal combustion engine 12 having an output shaft 13 and a microprocessor-based engine control module (ECM) 14. The engine 12 is equipped with a variable cam phaser (VCP) 16 that adjusts the phase of the camshaft 18 relative to the crankshaft 20 in response to a position command signal (POS_CMD) produced by ECM 14 on line 22. A crankshaft position sensor 24 is responsive to the passage of teeth formed on a flywheel 26 attached to crankshaft 20, and produces a CRANK signal on line 28 that includes a pulse corresponding to the passage of each flywheel tooth. Similarly, a camshaft position sensor 30 is responsive to the passage of teeth formed on a wheel 32 attached to camshaft 18, and produces a CAM signal on line 34 that includes a pulse corresponding to the passage of each tooth of wheel 32.

The ECM 14 includes a non-volatile memory (NVM) 15, and carries out a number of control routines for operating engine 12. Most of such control routines are conventional in nature and therefore not addressed herein. In relation to the present invention, for example, ECM 14 executes a conventional control routine for determining a desired position for phaser 16 and a closed-loop control (such as a conventional PID control) for adjusting POS_CMD to bring the actual position of phaser 16 into correspondence with the desired position. The present invention is directed to a routine carried out by ECM 14 for reliably determining the actual position of phaser 16 based on the pulsed signals CRANK and CAM and a set of stored base offsets, as explained below. In the illustrated embodiment, ECM 14 also receives an external clock signal CLK, although it will be understood that a similar signal may be generated internally.

Figure 2:
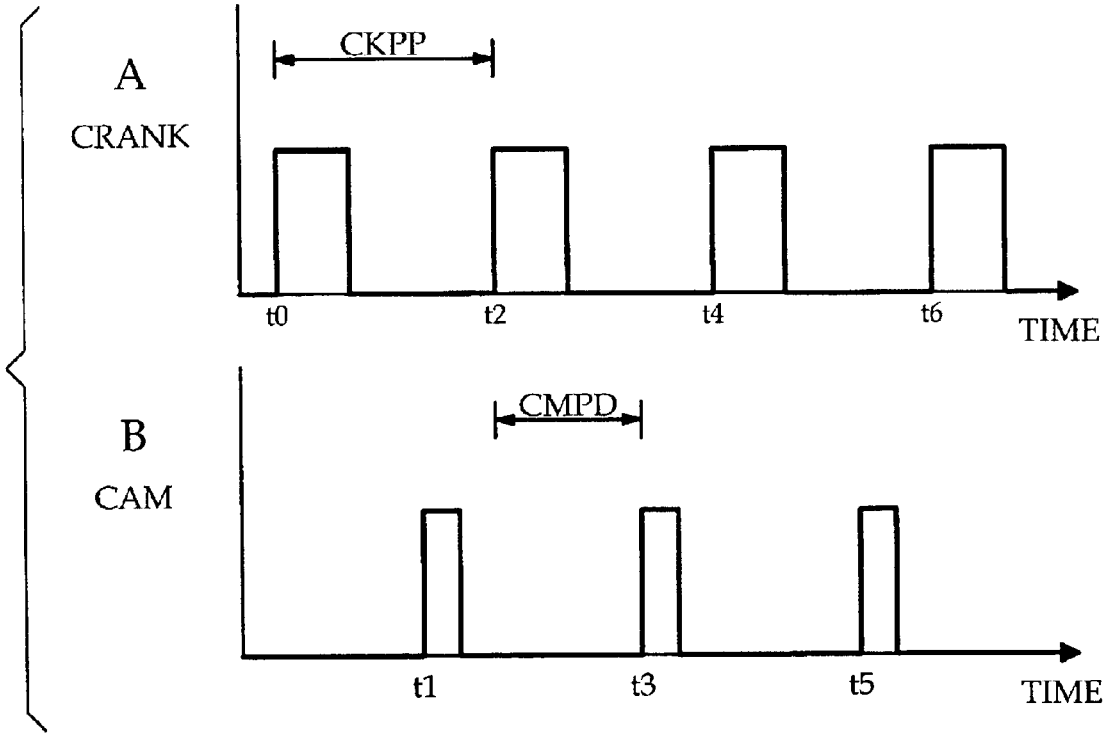
FIG. 2, Graphs A–B, respectively depict a series of crankshaft and camshaft position pulses developed during operation of the engine of FIG. 1.

Graphs A and B of FIG. 2 respectively depict representative CRANK and CAM pulse signals developed during operation of engine 12. The leading edges of the pulses are designated by the times t0–t6, and generate interrupts for ECM 14. In response to each such interrupt, ECM 14 records a clock value, which is used as explained herein to determine the relative timing of the pulses, and the relative position of phaser 16.

A dimensionless measure of the cam phase (CAM_PH_NEW) for any position of the phaser 16 may determined according to a ratio of the cam pulse delay CMPD to the crank pulse period CKPP, as disclosed in co-pending U.S. patent application Ser. No. 09/725,443, filed on Nov. 28, 2000. The cam pulse delay CMPD is defined by the time difference between successive crankshaft and camshaft pulses, as indicated for example, by the interval (t3–t2) in FIG. 2. The crank pulse period CKPP is defined by the time difference between successive crankshaft pulses, as indicated for example, by the interval (t2–t0) in FIG. 2. Thus, CAM_PH_NEW is given by:

$$CAM_PH_NEW = CMPD/CKPP \quad (1)$$

A base cam phase offset (BASE_OFFSET) corresponding to the cam phase that is achieved for a reference or default position of the phaser 16 is determined and stored in the NVM 15, and the current phaser position (PHASER_POS) is determined according to:

$$PHASER_POS=(BASE_OFFSET-CAM_PH_NEW)*K_CONV \quad (2)$$

where K_CONV is a conversion factor for converting the dimensionless difference (BASE_OFFSET−CAM_PH_NEW) to a physical parameter such as crank angle degrees. For example, K_CONV may be is the angle of crankshaft rotation between successive crankshaft pulses. Typically, the cam wheel 32 has several teeth, and individual base offset values are preferably determined for each such tooth. At engine start-up, the phaser 16 is commanded to a reference or default position, and the ECM 14 performs an initialization routine by determining base offset values and comparing them to the stored base offsets to establish an initial set of base offsets. During engine operation, the base offsets are subject to diagnostic testing and adaptive updating, and at engine shut-down, the updated base offsets are stored in NVM 15.

Figure 3:
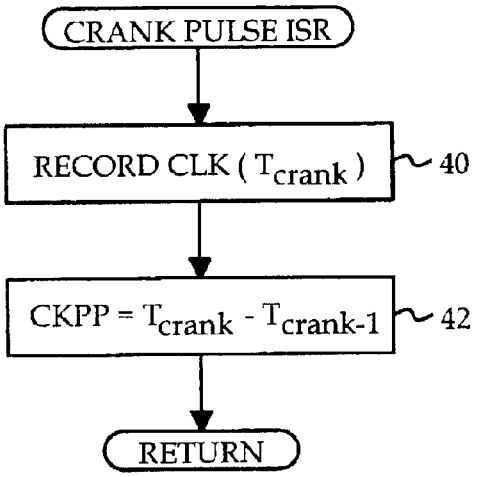
FIG. 3 is a flow diagram representative of an interrupt service routine executed by the engine control unit of FIG. 1 in response to the crankshaft position pulses depicted in Graph A of FIG. 2.
Figure 4:
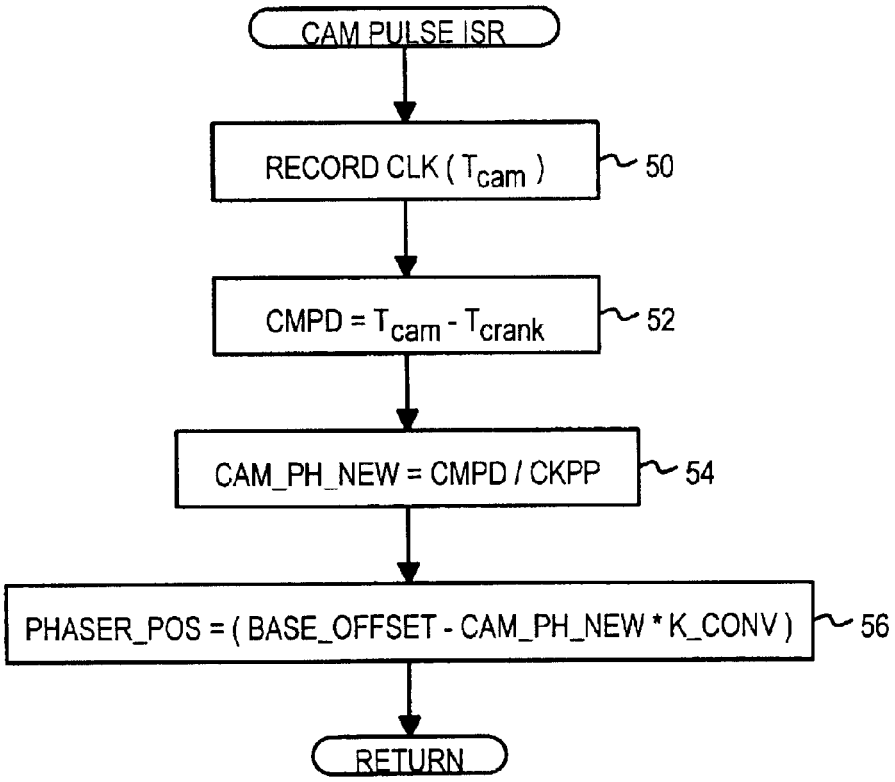
FIG. 4 is a flow diagram representative of an interrupt service routine executed by the ECM of FIG. 1 in response to the camshaft position pulses depicted in Graph B of FIG. 2.
Figure 5:
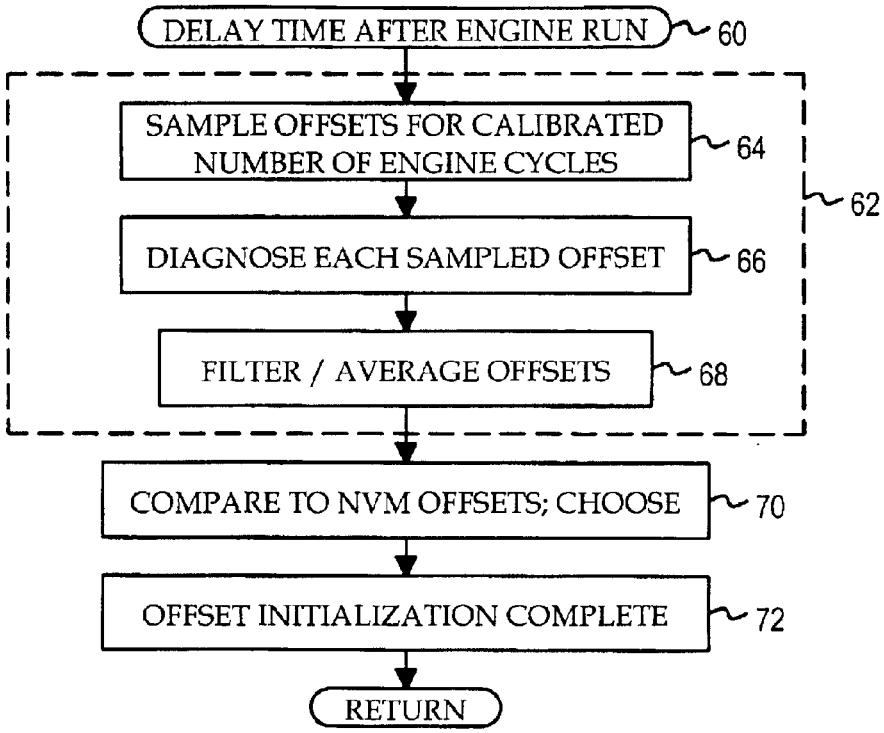
FIG. 5 is a flow diagram representative of a routine executed by the ECM of FIG. 1 at engine start for initializing base offsets.
Figure 6:
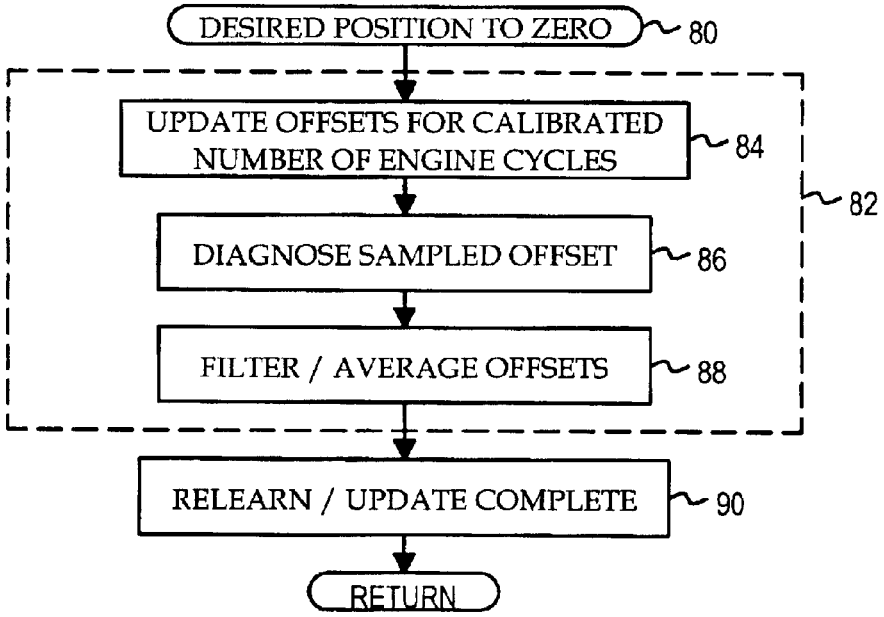
FIG. 6 is a flow diagram representative of a routine periodically executed by the ECM of FIG. 1 during engine operation for updating stored base offsets.
Figure 7:
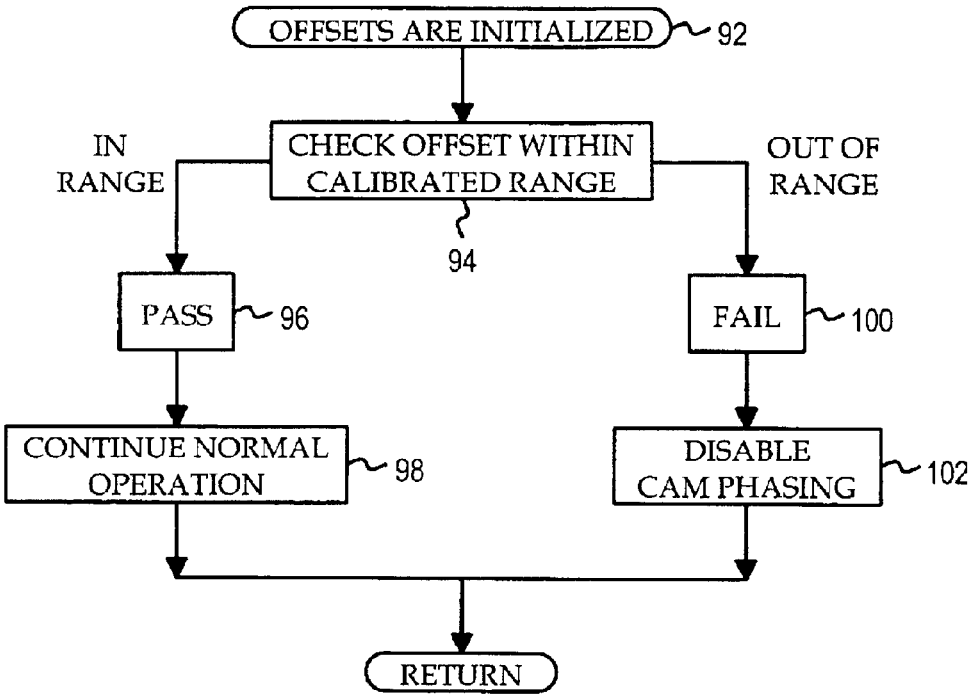
FIG. 7 is a flow diagram representative of a routine executed by the ECM of FIG. 1 during engine operation for diagnosing updated base offsets.
Figure 8:
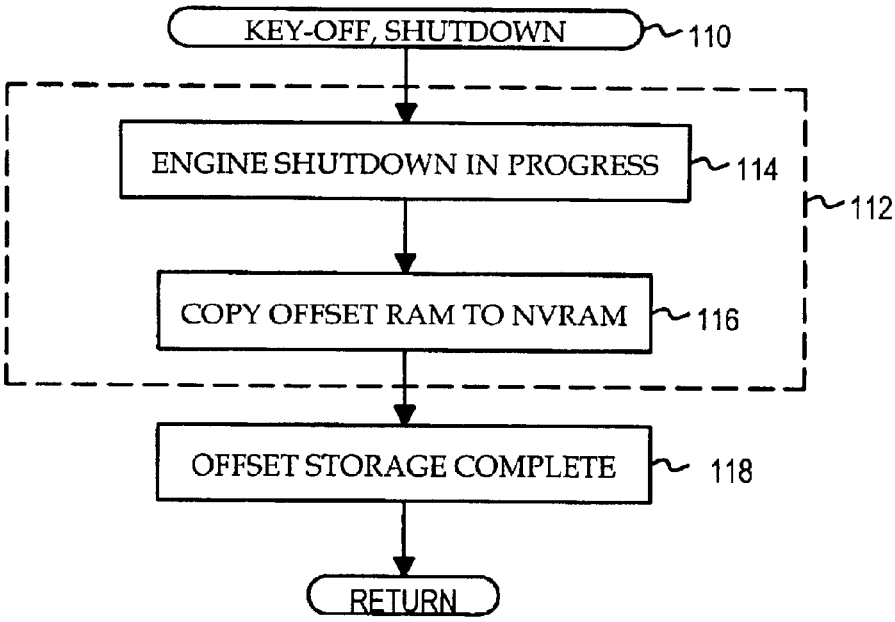
FIG. 8 is a flow diagram representative of a routine executed by the ECM of FIG. 1 at engine shut-down for storing updated base offsets.

FIGS. 3–8 are flow diagrams representative of various routines executed by ECM 14 in carrying out the method of this invention. FIGS. 3 and 4 are interrupt service routines executed in response to interrupts generated at the leading edges of the crank and cam pulses for computing CAM_PH_NEW and PHASER_POS. FIGS. 5–7 represent routines for initializing and diagnosing the base offset values, and FIG. 8 represents a routine executed at engine key-off for storing the current set of base offsets in NVM 15.

The crank pulse interrupt service routine of FIG. 3 is very simple, and essentially involves recording a clock value and computing the crank pulse period CKPP, as indicated at blocks 40 and 42, respectively.

The cam pulse interrupt service routine of FIG. 4 is represented by the blocks 50, 52, 54 and 56. The ECM 14 records a clock value Tcam at block 50, determines the cam pulse delay CMPD at block 52, and computes the new cam phase CAM_PH_NEW using equation (1) at block 54. Finally, the corresponding phaser position PHASER_POS is calculated using equation (2), as indicated at block 56.

The base offset initialization routine of FIG. 5 is executed a predefined delay time after the engine 12 transitions from crank to run, as indicated by block 60. At such time, the phaser 16 is presumed to be in a reference or default position, and the reference numeral 62 designates a sub-routine for computing base offsets for the various cam wheel teeth using equation (1). As indicated at blocks 64 and 66, the base offsets are sampled for a calibrated number of engine cycles, and the samples for each cam tooth are diagnosed by comparing them with calibrated thresholds. As indicated at blocks 68 and 70, base offset samples within the calibrated thresholds are filtered or mathematically averaged and compared with the base offsets stored in NVM 15. Since proper sampling of the base offsets requires a stable engine speed, the sample offsets are rejected when they differ significantly from the base offsets stored in NVM 15. On the other hand, the sampled base offsets are always used if the stored base offsets are invalid due to a failure of NVM 15 or if measurement algorithm calibrations have been changed since the previous period of engine operation. Once a set of base offsets has been selected, the block 72 sets a flag to indicate that offset initialization has been completed.

Once offset initialization has been completed, the routines of FIGS. 6 and 7 are periodically executed to update and diagnose the base offset values. The updating routine of FIG. 6 is periodically executed whenever the desired position of phaser 16 is the reference or default position, as indicated at block 80. The reference numeral 82 designates a sub-routine for sampling base offsets using equation (1) and updating the initialized base offsets to reflect deviation of the sampled offsets from the initialized offsets so long as the sampled offsets are within a set of calibrated thresholds. As indicated at blocks 84, 86, 88 and 90, the base offsets are updated for a calibrated number of engine cycles, and filtered or mathematically averaged before the previous set of base offsets is replaced. The diagnostic routine of FIG. 7 is periodically executed following offset initialization, as indicated by the block 92, and essentially involves comparing the base offsets with calibrated thresholds defining a valid base offset range, as indicated at block 94. If the base offsets are within the valid base offset range, the blocks 96 and 98 are executed to set a PASS flag and to permit continued normal operation of the phaser 16. If one or more of the base offsets is outside the valid base offset range, the blocks 100 and 102 are executed to set a FAIL flag and to discontinue cam phase control.

Finally, the routine of FIG. 8 is executed at engine key-off as an ECM shutdown routine, as indicated at block 110. The block 112 designates a sub-routine for copying the base offset values from volatile memory (RAM) to NVM 15 during the shutdown process, as indicated by the blocks 114 and 116. The routine is completed at block 118 when the base offsets have been transferred to NVM 15.

In summary, the present invention provides a method of determining phaser position by determining and storing adaptable base offsets corresponding to the phase offset of the camshaft 18 relative to the crankshaft 20 for a reference or default position of the phaser 16, and then determining the current phaser position relative to the base offset. Individual base offsets are stored in a non-volatile memory device 15 and updated during engine operation to account for mechanical and electrical variations that occur during engine operation. While described in reference to the illustrated embodiment, it is expected that various modifications in addition to those mentioned above will occur to those skilled in the art. Accordingly, it will be understood that methods incorporating these and other modifications may fall within the scope of this invention, which is defined by the appended claims.

What is claimed is:

1. A method of operation for an internal combustion engine having a crankshaft, a camshaft and a positionable phaser for changing a phase angle of the camshaft with respect to the crankshaft, the method comprising the steps of:

receiving a series of crankshaft pulses representative of crankshaft rotation, and a series of camshaft pulses representative of camshaft rotation;

calculating a base offset cam phase using the crankshaft and camshaft pulses when said phaser is commanded to a reference position;

calculating a current cam phase using the crankshaft and camshaft pulses when said phaser is commanded to a position other than said reference position; and determining a position of said phaser based on a deviation of said current cam phase from said base offset cam phase, further including:

storing said base offset cam phase at engine shut-down;

calculating sample base offset values using the crankshaft and camshaft pulses during a period following engine re-starting, and averaging said sample base offset values; and comparing the stored base offset cam phase to the averaged sample base offset values, and initializing said base offset cam phase based on such comparison.

2. The method of operation of claim 1, including the step of:

initializing said base offset cam phase in accordance with the stored base offset cam phase if there is substantial deviation between the averaged sample base offset values and the stored base offset cam phase.

3. The method of operation of claim 1, including the step of:

initializing said base offset cam phase in accordance with the averaged sample base offset values if the stored base offset cam phase is invalid.

4. The method of operation of claim 1, including the steps of:

periodically calculating sample base offset values using the crankshaft and camshaft pulses during operation of said engine when said phaser is commanded to said reference position;

averaging said sample base offset values; and updating said base offset cam phase in accordance with the averaged sample base offset values.

5. The method of operation of claim 4, including the step of:

rejecting sample base offset values falling outside a set of calibrated thresholds.

6. The method of operation of claim 4, including the step of:

updating said base offset cam phase by replacing said base offset cam phase with the averaged sample base offset values.

7. The method of operation of claim 1, including the steps of:

periodically comparing said base offset cam phase to a set of calibrated thresholds defining a valid base offset range; and disabling a control of said phaser if said base offset cam phase is outside said valid base offset range.

8. The method of operation of claim 1, wherein said engine includes a camshaft wheel having a plurality of teeth, and the camshaft pulses are produced in response to detected edges of said teeth, the method of operation including the steps of:

calculating a base offset cam phase for each of said plurality of teeth when said phaser is commanded to said reference position;

calculating said current cam phase using a camshaft pulse associated with a selected tooth of said camshaft wheel when said phaser is commanded to a position other than said reference position; and determining said position of said phaser based on a deviation of said current cam phase from a base offset cam phase calculated for said selected tooth.

* * * * *